US007373988B2

(12) United States Patent
Campbell et al.

(10) Patent No.: US 7,373,988 B2
(45) Date of Patent: May 20, 2008

(54) LINER RUNNING SYSTEM AND METHOD

(75) Inventors: John E. Campbell, Houston, TX (US); Charles H. Dewey, Houston, TX (US); Brian W. Cruickshank, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 234 days.

(21) Appl. No.: 10/932,766

(22) Filed: Sep. 2, 2004

(65) Prior Publication Data

US 2005/0051342 A1 Mar. 10, 2005

Related U.S. Application Data

(60) Provisional application No. 60/500,527, filed on Sep. 5, 2003.

(51) Int. Cl.
*E21B 23/01* (2006.01)

(52) U.S. Cl. ..... 166/377; 166/382; 166/208; 166/242.6; 166/125; 166/237

(58) Field of Classification Search ..... 166/382, 166/377, 208, 242.6, 125, 237
See application file for complete search history.

(56) References Cited

U.S. PATENT DOCUMENTS 2,345,888 A * 4/1944 Scott ..... 166/208
3,910,349 A * 10/1975 Brown et al. ..... 166/208
4,712,615 A 12/1987 Dockins, Jr. et al.
5,018,582 A * 5/1991 Baker ..... 166/382
5,048,606 A 9/1991 Allwin
5,360,069 A 11/1994 Schmuck et al.
5,472,055 A 12/1995 Simson et al.
5,526,888 A * 6/1996 Gazewood ..... 166/242.6
5,794,694 A 8/1998 Smith, Jr.
6,209,653 B1 * 4/2001 Pringle ..... 166/382
6,241,018 B1 6/2001 Eriksen
6,499,537 B1 * 12/2002 Dewey et al. ..... 166/382
6,752,211 B2 6/2004 Dewey et al.
2002/0084073 A1 7/2002 Underdown et al.
2003/0127225 A1 * 7/2003 Harrall et al. ..... 166/285
2004/0094309 A1 5/2004 Maguire

OTHER PUBLICATIONS

British Search Report dated Jan. 17, 2005, Application No. GB 0419606.9, 3 pages.

* cited by examiner

*Primary Examiner*—Richard E. Chilcot, Jr.
*Assistant Examiner*—Matthew J Smith
(74) *Attorney, Agent, or Firm*—Conley Rose, P.C.

(57) ABSTRACT

A liner running system for placing a liner in a well bore comprises a latch sleeve connected to the liner and a running tool releasably attached to the latch sleeve. The latch sleeve has a wall thickness substantially the same as the wall thickness of the liner, and the running tool has an outer diameter less than or equal to the inner diameter of the liner. The latch sleeve may be connected into the liner at any location along its length. The running tool is releasable from the latch sleeve via hydraulic actuation or mechanical actuation. Optionally, a swivel may be connected to the liner. The swivel has a wall thickness substantially the same as the wall thickness of the liner. The method for lowering the liner into the well bore via the liner running system comprises rotating the liner, pushing the liner, pulling the liner, or a combination thereof.

22 Claims, 4 Drawing Sheets

LINER RUNNING SYSTEM AND METHOD

CROSS-REFERENCE TO RELATED APPLICATIONS

The present application claims the benefit under 35 U.S.C. § 119(e) of U.S. Provisional Application Ser. No. 60/500,527 filed Sep. 5, 2003 and entitled "Liner Running System and Method", hereby incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention generally relates to a liner running system for placing liners in well bores traversing earth formations. More particularly, the present invention relates to a liner running system comprising a liner running tool having an outer diameter less than or equal to the inner diameter of a liner being run into the well bore, and a latch sleeve having a wall thickness that is substantially the same as the wall thickness of the liner.

BACKGROUND

When drilling or completing wells that traverse earth formations, an upper portion of the primary well bore is drilled from the earth's surface to a selected depth, and then lined with a first section of pipe, commonly referred to as surface casing. The surface casing is then cemented into place in the well bore. The next succeeding section of the primary well bore is drilled to a selected depth below the surface casing and then lined with a string of pipe, commonly referred to as a liner. For each succeeding section of well bore that is drilled, a liner string is installed into the open borehole, below the surface casing or a previously installed liner string. During this process, each liner string may be cemented into place in the well bore.

Once the primary well bore is drilled and lined, a secondary well bore, such as a lateral well bore, for example, may be drilled and also lined with a liner. To perform a liner installation in either a primary or a secondary well bore, a running tool is releasably attached to a liner string. The running tool is connected to a work string or drill pipe that lowers the liner from the earth's surface into the open borehole below the surface casing or a previously installed liner string. The liner string may be rotated via the running tool to clear any obstructions in the borehole and to reduce friction as the liner string is lowered toward the bottom of the borehole.

Each liner string is connected at its upper end to a tubular liner hanger or another type of connection tubular, such as a lateral tube that extends between a primary well bore and a secondary well bore. The liner is lowered on the running tool via the work string until the liner hanger or connection tubular is adjacent to or near the lower end of the surface casing or a previously installed liner string. Then the liner hanger is set to engage the surrounding pipe wall and support the weight of the liner. Alternatively, the connection tubular is attached to the lower end of a previously installed casing or liner. Once the liner string is set, the liner may be cemented into place. The running tool is subsequently released from the liner and retrieved with the work string as it is withdrawn from the well bore.

Liner running tools conventionally include either hydraulic release means or mechanical release means. However, some liner running tools include both hydraulic and mechanical release means. Incorporating two different types of release means in a running tool is desirable given that trips into a well bore are expensive and time consuming. Thus, if the hydraulic release means fails, or if a liner must be reset, selective use of mechanical or hydraulic release means is desirable.

As described above, concentric liner strings are installed in the borehole as drilling progresses to increasing depths in a primary well bore or increasing lengths in a secondary well bore. Each new liner string must be run through the previously installed surface casing or liner string. Therefore, as successively smaller diameter liner strings are set, the flow area for the production of oil and gas is reduced. To maximize the production flow area, it is desirable to install a liner string with as large a diameter and length as possible so that the bottom of the formation can be reached with a comparatively larger diameter liner, thereby providing more flow area for the production of oil and gas.

However, traditional liner running tools have an outer diameter substantially the same size as the outer diameter of the liner string. Therefore, such running tools can only attach to the top of the liner string, and they act to "push" the liner string into the borehole. The longer the liner string, the more difficult it is for a traditional running tool to "push" the liner string into the borehole, especially in a lateral well bore. Therefore, it may be advantageous for a running tool to be releasably attachable to the liner string at any position along its length. Such a design would allow for the running tool to be connected near the lower end of the liner string, for example, so that a very long liner string may be "pulled" rather than "pushed" into an open borehole.

Further, some liner strings include features, such as slots or windows, which create structural weak points in the liner string. A running tool that could be attached to a liner string below a structural weak point, for example, would prevent stressing the weak point and buckling the liner string as it is being lowered into an open borehole. Therefore, a need exists for a liner running tool that may be releasably attached to a liner string at any location along its length.

SUMMARY

The present invention is directed to a liner running system and method comprising a liner running tool that releasably attaches to a latch sleeve that, in turn, connects into a liner string. The liner running system may be used to deploy any downhole tubular.

In one aspect, a liner running system for placing a liner in a well bore comprises a latch sleeve connected to the liner and having a wall thickness substantially the same as the wall thickness of the liner, and a running tool releasably attached to the latch sleeve and having an outer diameter less than or equal to the inner diameter of the liner. In an embodiment, the latch sleeve may be connected into the liner at any location along its length. In another embodiment, the running tool is releasable from the latch sleeve via hydraulic actuation or mechanical actuation. Optionally, the liner running system may further comprise a swivel connected to the liner and having a wall thickness substantially the same as the wall thickness of the liner.

In another aspect, a method for placing a liner having a length, a wall thickness, and an inner diameter in a well bore comprises connecting a latch sleeve into the liner at any location along the length, releasably attaching to the latch sleeve a running tool having an outer diameter less than or equal to the inner diameter of the liner, running the liner into the well bore via the running tool, releasing the running tool from the latch sleeve, and removing the running tool from the well bore. In an embodiment, the method further comprises setting the liner. Running the liner into the well bore may comprise rotating the liner, pushing the liner, pulling the liner, or a combination thereof. Releasing the running tool from the latch sleeve may comprise applying a hydraulic force or a mechanical force.

In yet another aspect, a swivel connected into a liner comprises an upper portion and a lower portion rotatably connected to the upper portion, wherein the upper portion and the lower portion each have a wall thickness substantially the same as the wall thickness of the liner.

Other aspects and advantages of the invention will be apparent from the following description and the appended claims.

NOTATION AND NOMENCLATURE

Figure 1:
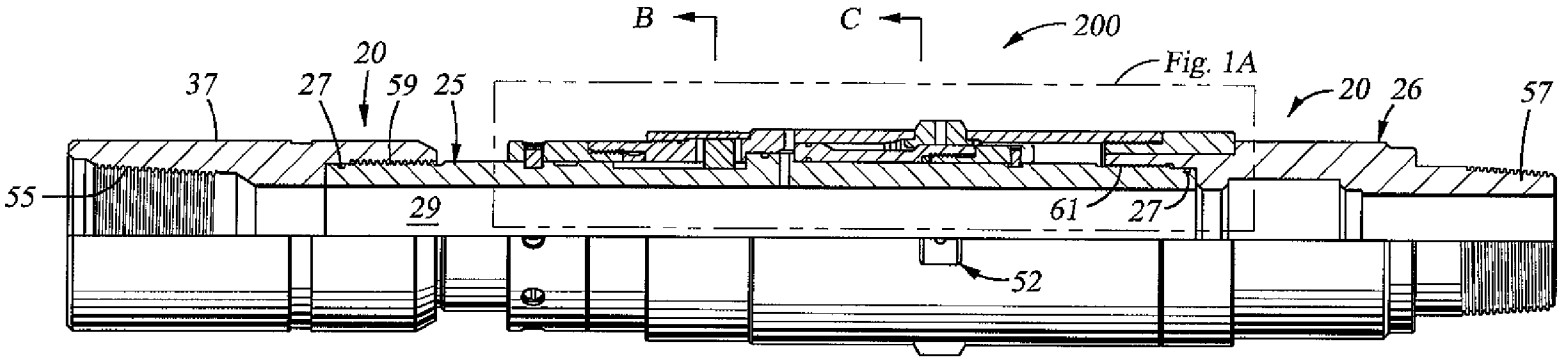
FIG. 1 is a cross-sectional side view of one embodiment of a liner running tool in the run-in position.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", or "upstream" meaning toward the earth's surface or toward the entrance of a well bore; and with "down", "lower", or "downstream" meaning toward the bottom of the well bore.

In the figures that follow, the cross-sectional side views of the liner running system should be viewed from left to right, with the upstream end on the far left side of the drawing and the downstream end on the far right side of the drawing.

DETAILED DESCRIPTION

Various embodiments of the liner running system and method will now be described with reference to the accompanying figures, wherein like reference characters are used for like features throughout the several views.

FIGS. 1-7 depict various components of one embodiment of a liner running system, generally designated as 100. The liner running system 100 comprises a liner running tool 20 that releasably attaches to a latch sleeve 40 that, in turn, connects into a liner string (not shown) at any location along its length. The liner running system 100 may be used to deploy any downhole tubular, such as, for example, a lateral tubular for lining a secondary lateral well bore. One such lateral tubular is depicted and described in U.S. Pat. No. 6,752,211 assigned to Smith International, Inc., hereby incorporated herein by reference for all purposes.

Figure 1A:
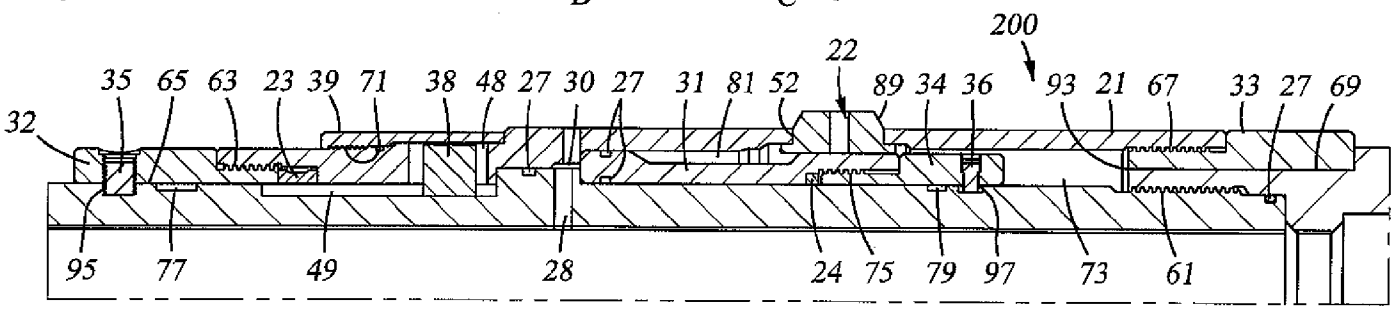
FIG. 1A is an enlarged, cross-sectional side view of a portion of the liner running tool of FIG. 1.
Figure 4:
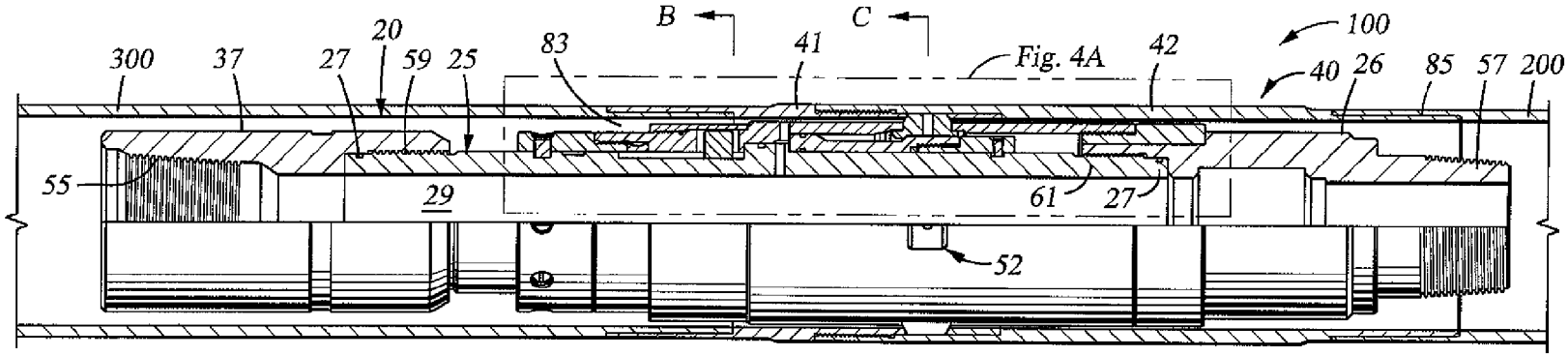
FIG. 4 is a cross-sectional side view of the liner running tool of FIG. 1, connected to one embodiment of a latch sleeve.

FIG. 1 and FIG. 1A depict the liner running tool 20 in the run-in position. For purposes of clarity, FIG. 1 and FIG. 1A show the liner running tool 20 without the latch sleeve 40 attached, although these components 20, 40 are releasably attached during run-in as shown in FIG. 4. Referring first to FIG. 1, the liner running tool 20 comprises a running top sub 37, a generally cylindrical mandrel 25, a releasable latching assembly 200, a nose 26, and a flowbore 29 that extends through the length of the running tool 20. The upper end of the running top sub 37 includes box threads 55, and the lower end of the nose 26 includes pin threads 57 for connecting the liner running tool 20 into a work string (not shown) that extends into the well bore from the earth's surface to lower the liner. The running top sub 37 is connected to mandrel 25 via threads 59, and the nose 26 is connected to mandrel 25 via threads 61. O-ring seals 27 are provided adjacent threads 59, 61.

Referring now to FIG. 1A, an enlarged view of one embodiment of a releasable latching assembly 200 is provided. The releasable latching assembly 200 comprises a body 21 connected at its upper end via threads 63 to a body lock ring nut 32 that slidingly engages the mandrel 25 at surface 65, and connected at its lower end via threads 67 to a piston retaining nut 33 that slidingly engages the nose 26 at surface 69. A body lock ring 23 is captured in a space between the body 21, the body lock ring nut 32, and the mandrel 25. The body lock ring nut 32 and the body 21 are releasably coupled to the mandrel 25 by at least one mechanical shear screw 35 engaging a groove 95 in the mandrel 25.

Figure 2:
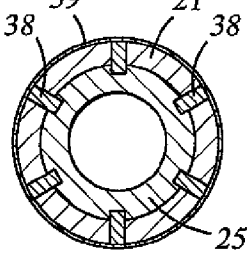
FIG. 2 is a cross-sectional end view of the liner running tool, taken along plane B-B of FIG. 1.

The body 21 includes recesses 48 adapted to partially contain torque keys 38. The torque keys 38 are held in place via a torque key retainer 39 that connects via threads 71 to the body 21. Corresponding with recesses 48 in the body 21 are slots 49 in the mandrel 25 within which torque keys 38 also partially reside. FIG. 2 depicts the torque keys 38 extending between the body 21 and the mandrel 25, such that when the liner running tool 20 is rotated via the work string, the torque keys 38 act to prevent relative rotation and transmit torsional forces between the mandrel 25 and the body 21 to drill down the liner as it is being lowered. However, as best shown in FIG. 1A, the slots 49 in the mandrel 25 enable axial movement of the torque keys 38, such that relative axial movement is possible between the mandrel 25 and the body 21.

Figure 3:
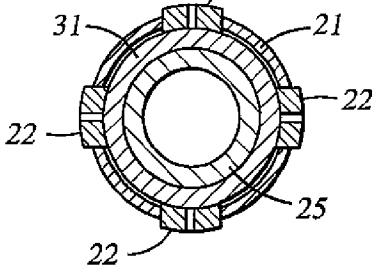
FIG. 3 is a cross-sectional end view of the liner running tool, taken along plane C-C of FIG. 1.
Figure 4A:
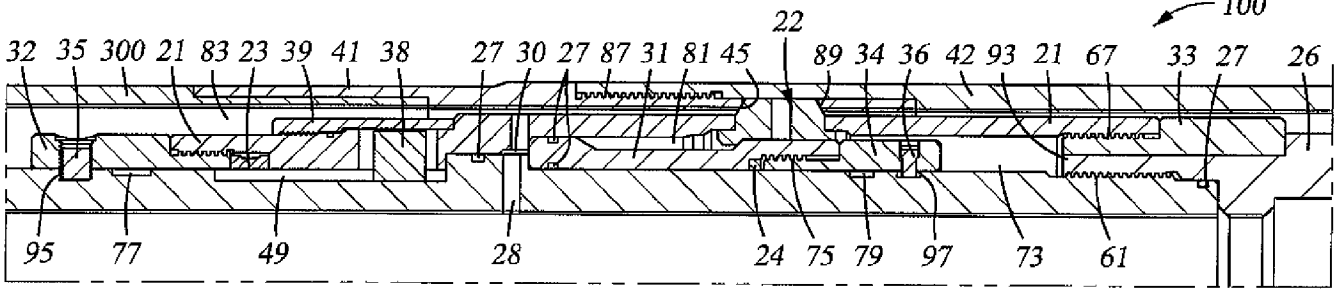
FIG. 4A is an enlarged, cross-sectional side view of a portion of the liner running tool and latch sleeve of FIG. 4.
Figure 6:
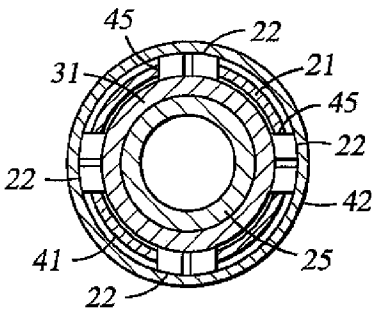
FIG. 6 is a cross-sectional end view of the liner running tool and latch sleeve taken along plane C-C of FIG. 4.
Figure 5:
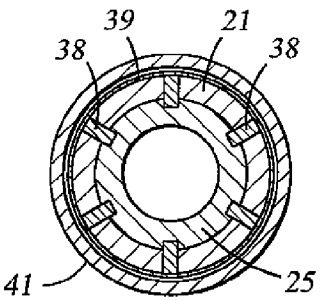
FIG. 5 is a cross-sectional end view of the liner running tool and latch sleeve taken along plane B-B of FIG. 4.

An axial recess 73 is formed by the body 21, the mandrel 25, the piston retaining nut 33, and the nose 26, and contained within the axial recess 73 is an actuatable piston 31 connected via threads 75 to a piston lock ring retaining nut 34. A piston lock ring 24 is captured in a space between the piston 31, the piston lock ring retaining nut 34, and the mandrel 25. The piston 31 is in fluid communication with the flowbore 29 via port 28 that leads into a piston chamber 30 formed by O-rings 27 in the mandrel 25 and the piston 31. The piston lock ring retaining nut 34 and piston 31 are releasably coupled to the mandrel 25 by at least one hydraulic shear screw 36 that engages a groove 97 in the mandrel 25. The body 21 also contains a plurality of passages 52 adapted to receive latch dogs 22. As best shown in FIG. 1A and FIG. 3, the latch dogs 22 are biased radially outwardly by the piston 31 to extend past the body 21 in the run-in position. As best shown in FIG. 4A and FIG. 6, the latch dogs 22 are adapted to engage recesses 45 in the latch sleeve 40. The hydraulic shear screw 36 ensures that the piston 31 is held in the upper run-in position and does not stroke downwardly due to vibration to release the latch sleeve 40 as the running tool 20 is run into the well bore.

Referring now to FIG. 4 and FIG. 4A, the running tool 20 is again depicted in the run-in position and releasably attached to the latch sleeve 40. In one embodiment, the latch sleeve 40 includes a latch sleeve top sub 41 connected via threads 87 to a latch sleeve bottom sub 42 with an O-ring seal 27 adjacent threads 87. The upper box end 83 of the latch sleeve tap sub 41 and the lower pin end 85 of the latch sleeve bottom sub 42 allow the latch sleeve 40 to connect into a liner string 200 at any location along its length. The latch sleeve top sub 41 contains recesses 45 to receive the latch dogs 22 extending radially outwardly front the running sub 20 in the run-in position.

Figure 7A:
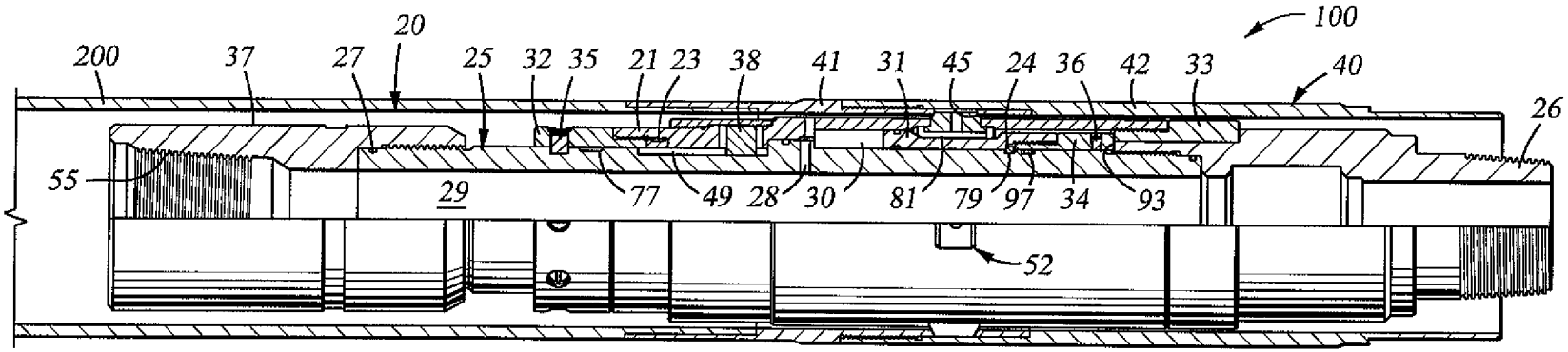
FIG. 7A is a cross-sectional side view of the liner running tool and latch sleeve of FIG. 4 in the released position after hydraulic actuation.
Figure 7B:
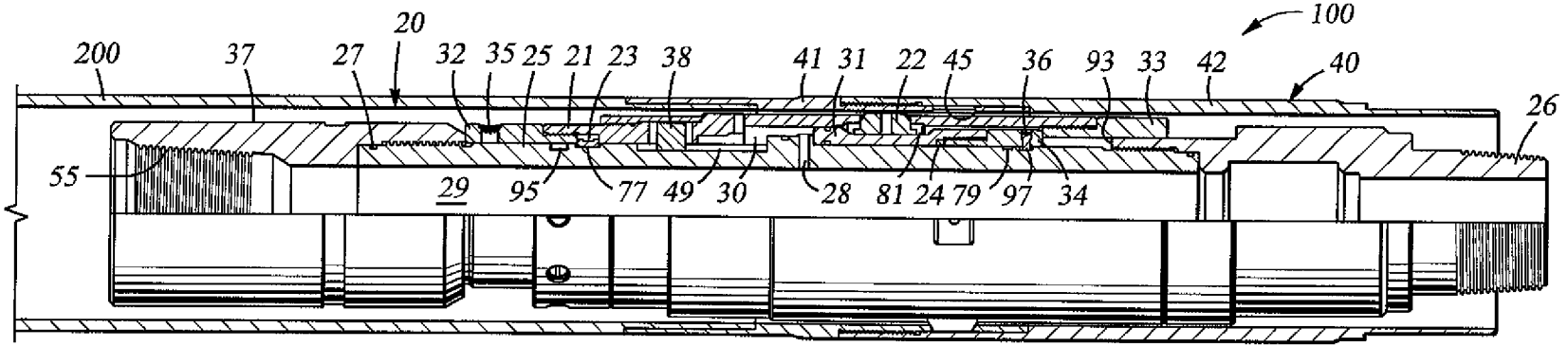
FIG. 7B is a cross-sectional side view of the liner running tool and latch sleeve of FIG. 4 in the released position after mechanical actuation.

In operation, the liner running system 100 may be used to run any downhole tubular into a primary or secondary well bore. To lower a liner 200 into a well bore, the running tool 20 is connected to the latch sleeve 40 as shown in FIG. 4, and the latch sleeve 40, in turn, is connected into a liner string 200 which may be several thousand feet long, for example. The liner running tool 20 has an outer diameter less than or equal to the inner diameter of the liner string 200, which allows the running tool 20 to be disposed internally of the liner 200. The latch sleeve 40 has a wall thickness substantially the same as the wall thickness of the liner string 200, and the latch sleeve 40 is adapted to remain in the well bore to form part of the liner string 200 once the running tool 20 is released. The latch sleeve 40 may be connected into the liner 200 at any location along its length. In one embodiment, as shown in FIG. 4, the latch sleeve 40 is connected via box end 83 to the lower end of a connection tubular 300, such as a lateral tubular, for example, and via pin end 85 to the upper end of the liner string 200. With the latch sleeve 40 connected to the upper end of the liner 200, the running tool 20 and latch sleeve 40 act to "push" the liner 200 into the borehole. However, if the liner 200 is very long, or if it engages obstructions as it is being lowered, the force exerted on the top and bottom of the liner 200 may create a buckling stress in the liner 200. Therefore, in another embodiment, the latch sleeve 40 is connected at or near the lower end of a liner string 200, as shown in FIG. 7A and FIG. 7B. By extending the work string and liner running tool 20 into the liner 200 and connecting the running tool 20 to the latch sleeve 40 at or near the lower end of the liner 200, the running tool 20 and latch sleeve 40 can then act to "pull" the liner 200 into the borehole to eliminate or diminish buckling stress. This is particularly advantageous for long liner strings 200, which are difficult to push into an open borehole, especially secondary lateral well bores. In another embodiment, the latch sleeve 40 is connected into the liner 200 below a structural weak point, such as a slot or window, so as to avoid stressing the weak point. When running the liner 200 by either pushing or pulling, the work string may be rotated from the earth's surface, thereby rotating the liner running tool 20 due to the torque keys 38 in the running tool 20. Specifically, the torque keys 38 connect the mandrel 25 to the body 21, and because the latch dogs 22 engage the latch sleeve 40, the liner 200 is rotated with the running tool 20 so as to drill down the liner 200 as it is being lowered.

The running tool 20 is designed to selectively release the latch sleeve 40 by either hydraulic or mechanical actuation. FIG. 7A depicts the running tool 20 released from the latch sleeve 40 following hydraulic actuation. To actuate the hydraulic release, a ball, a plug, or the like is dropped down the work string, and passes through the flowbore 29 to a ball seat (not shown) disposed in the work string downstream of the running tool 20. The ball on the ball seat blocks flow through the work string, such that fluid pressure builds behind the ball and within flowbore 29, which creates hydraulic pressure that is transmitted into the piston chamber 30 via port 28. Upon the buildup of a predetermined hydraulic pressure, hydraulic shear screw 36 will shear, thereby allowing the piston 31 to move downwardly within axial recess 73 until the piston lock ring retaining nut 34 engages a shoulder 93 on the nose 26 at the lower end of the axial recess 73. Groove 97 in the mandrel 25 is left open after the hydraulic shear screw 36 shears. The piston lock ring 24 is a spring loaded ring, commonly referred to as a "spring ring," that is stretched over the mandrel 25 in the position shown in FIG. 1. The piston lock ring 24 moves with the piston 31 and contracts into a groove 79 (as best shown in FIG. 1A) in the mandrel 25 to thereby lock the piston 31 in the lower, released position. With the piston 31 in its lowermost position, an undercut surface 81 on the piston 31 is positioned below the latch dogs 22. The work string and running tool 20 are then lifted from the earth's surface, such that the latch dogs 22 are driven radially inwardly into the running tool 20, thereby releasing latch sleeve 40 as shown in FIG. 7A. In more detail, as best shown in FIG. 1A and FIG. 4A, the latch dogs 22 include angled camming surfaces 89 designed to engage corresponding tapered shoulders 91 on the recesses 45 in the latch sleeve top sub 41, such that when the work string and the liner running tool 20 are lifted up from the earth's surface, the latch dogs 22 are retracted radially inwardly.

In one embodiment, a mechanical release is an emergency release operation performed only if the hydraulic release does not work. FIG. 7B depicts the running tool 20 being removed from the well bore after release from the latch sleeve 40 via mechanical actuation. To actuate a mechanical release, a predetermined axial force may be applied to the running tool 20 to shear the mechanical shear screw 35 by setting weight down on the work string from the earth's surface. When the mechanical shear screw 35 shears, the axial force being applied from the earth's surface to the running tool 20 causes an axial downward motion of the mandrel 25 and the piston 31, which are still connected via hydraulic shear screw 36 through piston lock ring retaining nut 34. The extent of axial movement is limited by the shoulder 93 on the nose 26. As the mandrel 25 moves axially downwardly, the piston 31 moves within axial recess 73 until it engages the shoulder 93. Simultaneously, downward movement of the mandrel 25 with respect to the body 21 allows the body lock ring 23, which is a spring ring, to contract into a groove 77 in the mandrel 25 to thereby lock the mandrel 25 in place with the piston 31 in the lower, release position. Groove 95 in the mandrel 25 is left open once the mechanical shear screw 35 shears. With the piston 31 in its lowermost position, the undercut surface 81 on the piston 31 is positioned below the latch dogs 22. The work string and the liner running tool 20 are then lifted from the earth's surface, such that the latch dogs 22 are driven radially inwardly into the running tool 20, thereby releasing latch sleeve 40. FIG. 7B shows the running tool 20 as it is being withdrawn from the latch sleeve 40, whereby the piston retaining nut 33 slides along surface 69 of the nose 26, and the latch dogs 22 retract out of recesses 45 in the latch sleeve 40 to move upwardly with the running tool 20. Either the piston lock ring 24 disposed in groove 79 following hydraulic actuation, or the body lock ring 23 disposed in groove 77 following mechanical actuation, prevents the piston 31 from rattling or shaking to move upwardly as the work string and the liner running tool 20 are pulled out of the well bore so that the latch dogs 22 are not extended radially outwardly again.

Figure 9:
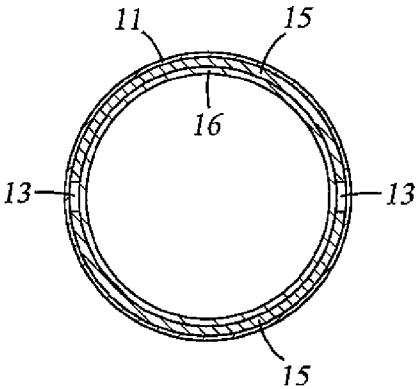
FIG. 9 is a cross-sectional end view of the swivel, taken along plane B-B of FIG. 8.
Figure 8:
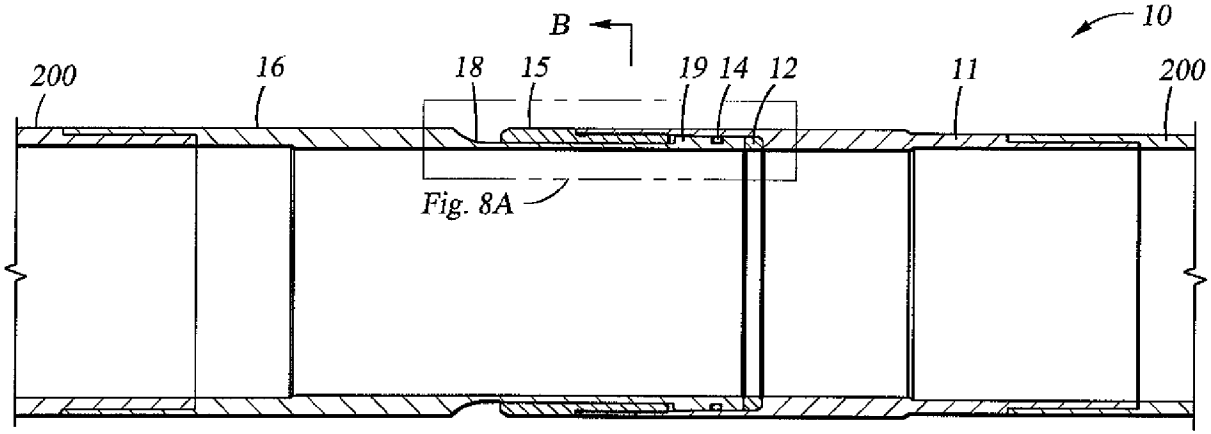
FIG. 8 is a cross-sectional side view of one embodiment of a swivel.
Figure 8A:
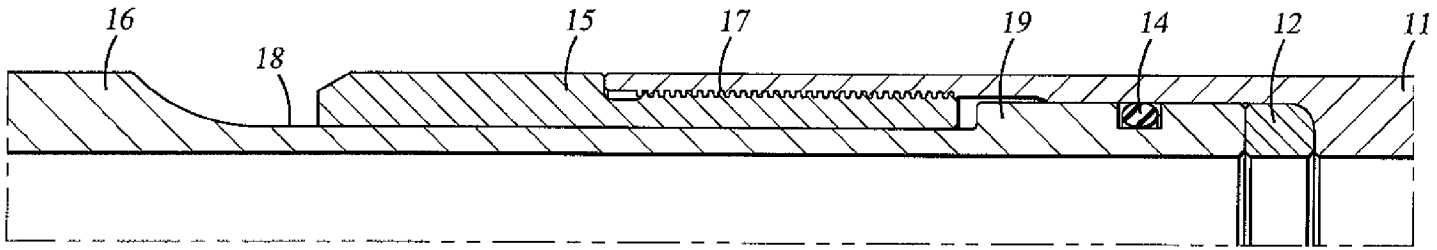
FIG. 8A is an enlarged, cross-sectional side view of a portion of the swivel of FIG. 8.

Referring now to FIG. 8, FIG. 8A, and FIG. 9, in another embodiment, a swivel 10 may be installed to rotatably connect two tubulars together. In an embodiment, swivel 10 has a wall thickness that is substantially the same as the wall thickness of the liner 200, and therefore, swivel 10 may be connected into the liner string 200 at any location along its length. In one embodiment, the swivel 10 may be connected between two sections of liner. In another embodiment, the swivel 10 may be connected between the latch sleeve 40 and the top of a liner string 200. Many other variations are possible, and the swivel 10 may be connected into the latch sleeve/liner assembly at any point where it would be desirable to rotate the portion above the swivel 10 while not rotating the portion below the swivel 10, or vice versa.

In one embodiment, the swivel 10 comprises a top sub 16, a bottom sub 11, and a retainer nut 15. Retainer nut 15 is connected via threads 17 to bottom sub 11 and slidingly engages the top sub 16, thereby rotatingly connecting top sub 16 to bottom sub 11. Retainer nut 15 is disposed between an undercut area 18 and a shoulder 19 on the top sub 16, and O-ring 14 in the shoulder 19 assists in sealing the connection between the swivel components 16, 11, 15. In one embodiment, the retainer nut 15 comprises two semi-circular sections. During assembly of the swivel 10, spacers 13 may be provided (as best shown in FIG. 9) to complete any gaps between the two sections of the retainer nut 15. The retainer nut 15 and spacers 13 are placed in the undercut area 18 and then connected to the bottom sub 11 via threads 17. Bearing ring 12, which may comprise brass, for example, is provided to prevent excess tightening of the retainer nut 15, and also to reduce friction during operation when weight is exerted on the top sub 16 while the top sub 16 is rotated with respect to the bottom sub 11.

The foregoing descriptions of specific embodiments of the liner running system 100, as well as the systems and methods for running a liner 200 into a primary or secondary well bore were presented for purposes of illustration and description and are not intended to be exhaustive or to limit the liner running systems and methods to the precise forms disclosed. Obviously many other modifications and variations are possible. For example, the various components of the liner running tool 20, the latch sleeve 40, and the swivel 10 may be varied.

Accordingly, while various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. The different teachings of the embodiments discussed herein may be employed separately or in any suitable combination to produce desired results. Accordingly, the scope of protection is not limited by the description set out above, but is defined by the claims which follow, that scope including all equivalents of the subject matter of the claims.

What is claimed is:

1. A liner running system for placing a liner having a wall thickness and an inner diameter in a well bore comprising:

a latch sleeve connected to the liner and having an inner diameter and a wall thickness substantially the same as the wall thickness of the liner; and a running tool releasably attached to the latch sleeve and having an outer diameter less than or equal to the inner diameter of the liner and the inner diameter of the latch sleeve;

wherein the liner has a length and the latch sleeve may be connected into the liner at any location along the length.

2. The liner running system of claim 1 wherein the running tool is releasable from the latch sleeve via hydraulic actuation or mechanical actuation.

3. The liner running system of claim 1 further comprising a swivel connected to the liner and having a wall thickness substantially the same as the wall thickness of the liner.

4. A method for placing a liner having a length, a wall thickness, and an inner diameter in a well bore comprising:

connecting a latch sleeve having an inner diameter into the liner at any location along the length;

releasably attaching to the latch sleeve a running tool having an outer diameter less than or equal to the inner diameter of the liner and the inner diameter of the latch sleeve;

running the liner into the well bore using the running tool;

releasing the running tool from the latch sleeve; and removing the running tool from the well bore.

5. The method of claim 4 further comprising setting the liner.

6. The method of claim 4 wherein the latch sleeve has a wall thickness substantially the same as the wall thickness of the liner.

7. The method of claim 4 wherein the running tool is disposed internally of the latch sleeve.

8. The method of claim 4 wherein running the liner into the well bore comprises rotating the liner, pushing the liner, pulling the liner, or a combination thereof.

9. The method of claim 4 wherein releasing the running tool from the latch sleeve comprises applying a hydraulic force or a mechanical force.

10. The method of claim 4 further comprising connecting a swivel to the liner at any location along the length, wherein the swivel has a wall thickness substantially the same as the wall thickness of the liner.

11. The liner running system of claim 1 wherein the running tool comprises:

an actuatable piston having a first position wherein the running tool is attached to the latch sleeve, and a second position wherein the running tool is releasable from the latch sleeve.

12. The liner running system of claim 11 further comprising a shear screw that maintains the piston in the first position until adequate force is applied to shear the shear screw.

13. The liner running system of claim 11 further comprising a lock ring that maintains the piston in the second position.

14. The liner running system of claim 11 wherein the piston is actuatable via hydraulic force or mechanical force.

15. The liner running system of claim 11 further comprising:

a lock dog, wherein the lock dog is extended to attach the running tool to the latch sleeve in the first position, and wherein the lock dog is retractable to release the running tool from the latch sleeve in the second position.

16. The method of claim 4 wherein the well bore comprises a primary well bore or a secondary well bore.

17. The method of claim 5 wherein setting the liner comprises attaching a connection tubular to a casing or another liner previously installed in the well bore.

18. The method of claim 5 wherein setting the liner comprises setting a liner hanger to connect the liner to a casing or another liner previously installed in the well bore.

19. The method of claim 10 further comprising rotating the liner above the swivel while the liner below the swivel does not rotate.

20. The method of claim 10 further comprising rotating the liner below the swivel while the liner above the swivel does not rotate.

21. A liner running system connected into a liner having a wall thickness comprising:

a latch sleeve connected to the liner and having an inner diameter;

a running tool releasably attached to the latch sleeve and having an outer diameter less than or equal to the inner diameter of the latch sleeve; and a swivel comprising:

an upper portion; and a lower portion rotatably connected to the upper portion;

wherein the upper portion and the lower portion each have a wall thickness substantially the same as the wall thickness of the liner.

22. The swivel of claim 21 wherein the liner has a length, and the swivel may be connected into the liner at any location along the length.

* * * * *